United States Patent [19]

Yocum

[11] Patent Number: 5,020,777

[45] Date of Patent: Jun. 4, 1991

[54] HIGH LIFT JACK

[76] Inventor: David C. Yocum, 557 S. 600 W., Orem, Utah 84058

[21] Appl. No.: 556,555

[22] Filed: Jul. 23, 1990

[51] Int. Cl.[5] ..... B66F 3/02

[52] U.S. Cl. ..... 254/95; 74/89; 74/422

[58] Field of Search ..... 254/95-97, 254/427; 74/89, 422, 49, 50

[56] References Cited

U.S. PATENT DOCUMENTS

| | | | |
|---|---|---|---|
| 189,468 | 4/1877 | Johnson . | |
| 444,427 | 1/1891 | Edwards . | |
| 1,228,015 | 5/1917 | Gates et al. . | |
| 1,410,968 | 3/1922 | Urquhart . | |
| 1,584,087 | 5/1926 | Gelder | 254/97 |
| 2,383,204 | 8/1945 | LeVeque | 254/97 |
| 3,765,651 | 10/1973 | Litterth . | |
| 3,850,042 | 11/1974 | Litterth . | |

FOREIGN PATENT DOCUMENTS

| | | | |
|---|---|---|---|
| 2338713 | 2/1975 | Fed. Rep. of Germany | 254/97 |

*Primary Examiner*—Robert C. Watson

*Attorney, Agent, or Firm*—Thorpe, North & Western

[57] ABSTRACT

An inexpensive, self-locking, high-lift jack constructed of high strength materials. The jack comprises a rail having spaced apart parallel rows of offset notches and a base support stand in which the rail is vertically mounted. A rider member reciprocates on the rail. The rider includes a crankshaft having two diametrically offset pinions projecting out from opposite faces of a central support surface thereof. Each pinion is positioned to engage the notches of one of the pair of parallel rows of notches on the rail. The crankshaft is fixed to and projects from the rider housing which encloses both the pinions and the section of rail engaged thereby. The rider has an L-shaped lifting members extending therefrom which functions as a load platform. A handle is attached to the crankshaft and turning of the handle rotates the crankshaft to sequentially move the pinions into and out of the notches in the rail which has the effect of raising or lowering the rider and any load applied to the L-shaped lifting members. The crankshaft turns in a central guide of the housing which travels in a space between parallel rails during movement of the rider with respect to the rail.

5 Claims, 2 Drawing Sheets

HIGH LIFT JACK

BACKGROUND OF THE INVENTION (1) Field of the Invention

This invention relates to jacks and the like for lifting and lowering heavy loads. More specifically, this invention relates to a jack which incorporates a rack and pinon gearing system for lifting or lowering a vehicle or load.

(2) Prior Art

High Lift Jacks are well known as a means for lifting vehicles or other loads. Such jacks conventionally include an elongate toothed track (rack), a support base, a ratchet assembly operated by a handle, and a lift assembly which is attached to the load for lifting. Generally, the prior art jacks employ spring loaded pawls which limit the direction of travel of the lifting platform or assembly. In some instances, it has been known in the prior art to employ a pair of elongated racks with which a ratchet and pawl assembly cooperates to lift or lower a heavy object. Samples of such prior art devices are shown in U.S. Pat. No. 1,228,015 to Gates, et al., U.S. Pat. No. 444,427 to Edwards, U.S. Pat. No. 1,410,968 to Urquhart, and U.S. Pat. No. 189,468 to Johnson.

The Urquhart Gates, et al. and Johnson patents disclose jacks which include a pair of rack assemblies. In operation, the racks themselves are displaced relative to the ratchet and pawl assembly. This design characteristic tends to cause the jack to be quite complicated in manufacture, as is quite evident in the number of structural elements required to manufacture these jacks. Also this same design characteristic tends to contribute to instability of jack during use.

In regard to the Edwards device, the pair of rack members employed in his jack are stationary relative to its base and the ratchet and pawl system move up and down relative to the racks. The Edwards jack also employs a rack and pinion gearing system. However, in the Edwards jack, the gearing on the double racks functions only to catch the pawls which hold the lifting mechanism in place. The third rack which employs the rack and pinion system is only part of the lifting mechanism. The third rack functions in conjunction with the pinion only for the purpose of moving one portion of the lifting mechanism relative to the other, and does not mechanically interact directly with the double racks. Again, this system is very complicated and very expensive to manufacture. This system is also quite complicated and difficult to operate.

There therefore exists in the jack technology a need for a jack which can safely and easily lift heavy objects, and which will also remain stable during lifting. Further, there exists a need for a jack which has very few total parts so that it can be cheaply and easily manufactured. Finally, there exists a need for a jack which is very simple to operate.

OBJECTS AND SUMMARY OF THE INVENTION

A principle object of the present invention is to provide an inexpensive but durable, jack that is easily assembled for lifting and lowering heavy loads.

It is further an object of the present invention to provide such a jack which has a minimum of parts incorporated therein in order to increase the durability and longevity of the jack and to facilitate inexpensive manufacture thereof.

It is another object of the present invention to provide a jack which incorporates a rack and pinion mechanism for lifting instead of the ratchet and pawl type system used in prior art devices.

The above and other objects of the present invention are realized in a high lift jack which includes a linear, elongate rail having a pair of rack members which form a portion thereof oriented in parallel spaced apart relationship there along, with the teeth of each rack member being directed away from the rail in a direction generally perpendicular to the longitudinal axis thereof, and the teeth of one rack extending away from the rail in a direction parallel to the teeth of the opposite rack. The teeth of each rack are uniformly located there along in spaced apart relationship with uniform, semi-cylindrical notches located between each tooth. The racks are so located on the rail that the teeth of one rack are located so as to be opposite the notches of the other rack in an offset fashion along the longitudinal length the rail.

The jack further includes a rider which includes a generally L-shaped lifting member attached to a generally boxed shaped housing, the housing being generally hollow and square in cross-section to allow the rail and rack members to pass therethrough. The housing includes a guide which is located between the spaced apart rack members when the rack members are inserted through the housing. A crank shaft extends through the housing and guide and includes a pair of pinions which include cylindrical shaped bushings therearound and which are sized to fit in the semi-cylindrical shaped notches of the racks. The crank shaft is attached to a handle in such a manner that the crank shaft will rotate with rotation of the handle. If desired, bearings or bushings may be located around the crank shaft at its connection with the housing and the guide member.

When the handle is rotated, the crank shaft rotates therewith and causes the pinions to rotate into and out of engagement with the notches of the rack members, the pinions being offset from the center of rotation of the crankshaft a distance equivalent to the longitudinal distance between notches on alternate racks. As the crankshaft rotates, the pinions progress up or down the racks as they rotate into and out of engagement with the notches therein.

The pinions are offset from the central longitudinal axis of the crank shaft a distance of approximately 180 degrees. Therefore, during all rotational positions of the crank shaft, at least one pinion is located in a notch of at least one rack at all times. Also, at two positions of rotation of the crank shaft, both pinions are at least partially engaged in a notch of each rack, thus locking the rider in position relative to the rail (i.e. thus preventing a load on the lifting member from generating a rotational force in the crank shaft which would tend to cause the rider to progress down the rail in an uncontrolled manner when the user lets go of the handle).

DETAILED DESCRIPTION OF THE INVENTION

Figure 1:
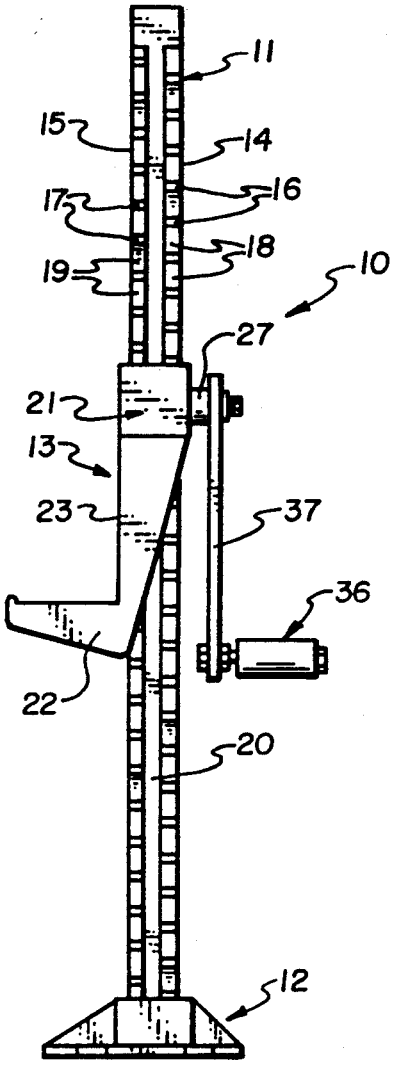
FIG. 1 is a front elevation view of a jack made in accordance with principles of the present invention.
Figure 2:
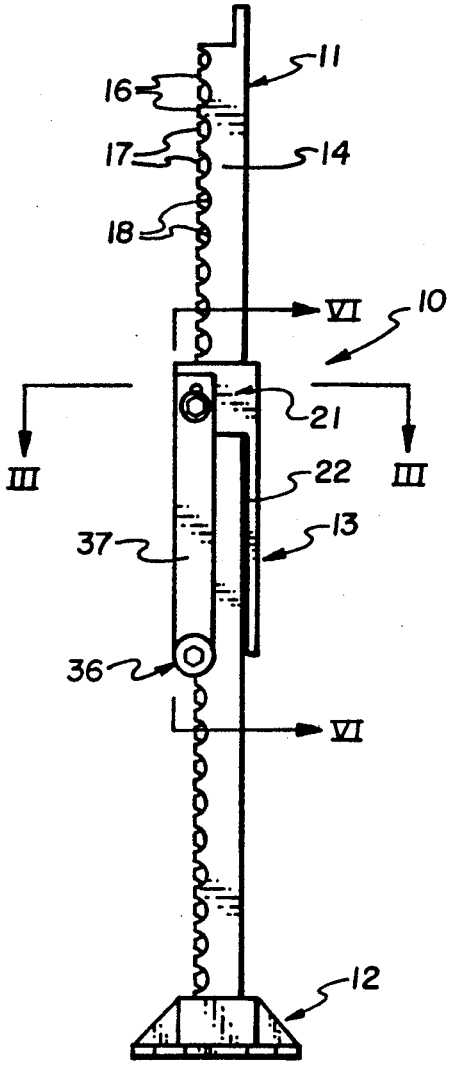
FIG. 2 is a side elevation view of the jack as shown in FIG. 1.

As shown in FIGS. 1, the jack 10 of the present invention comprises a rail 11 which is adapted to be inserted into, and to be vertically supported by, a base support stand 12. The jack 10 also includes a rider 13 which is free to reciprocate along the longitudinal length of rail 11.

The rail 11 includes a pair of elongate rack gears 14 and 15 which are formed as part of the rail 11 and are oriented generally in a spaced apart parallel relationship relative to each other along the longitudinal axis of the rail 11. Each rack member 14 and 15 includes a plurality of teeth 16 and 17 respectively which are located along each rack 14 and 15 in uniform spaced apart relationship. Each tooth 16 and 17 is spaced apart from its adjacent tooth 16 or 17 by uniformly sized, semi-cylindrical shaped notches 18 and 19 respectively.

The teeth 16 and 17 are directed in a generally perpendicular direction from the longitudinal axis of the rail and generally parallel to each other.

The notches 18 are misaligned so as to be staggered or offset relative to notches 19 along the longitudinal axis of the rail 11.

The racks 14 and 15 of rail 11 are spaced apart so as to form an elongate generally U-shaped channel 20 therebetween.

The rider 13 comprises a generally hollow, tubular, rectangularly cross-sectioned housing 21 from which extends a pair of generally L-shaped lifting members 22 which support an L-shaped support surface and lifting platform 23.

Figure 3:
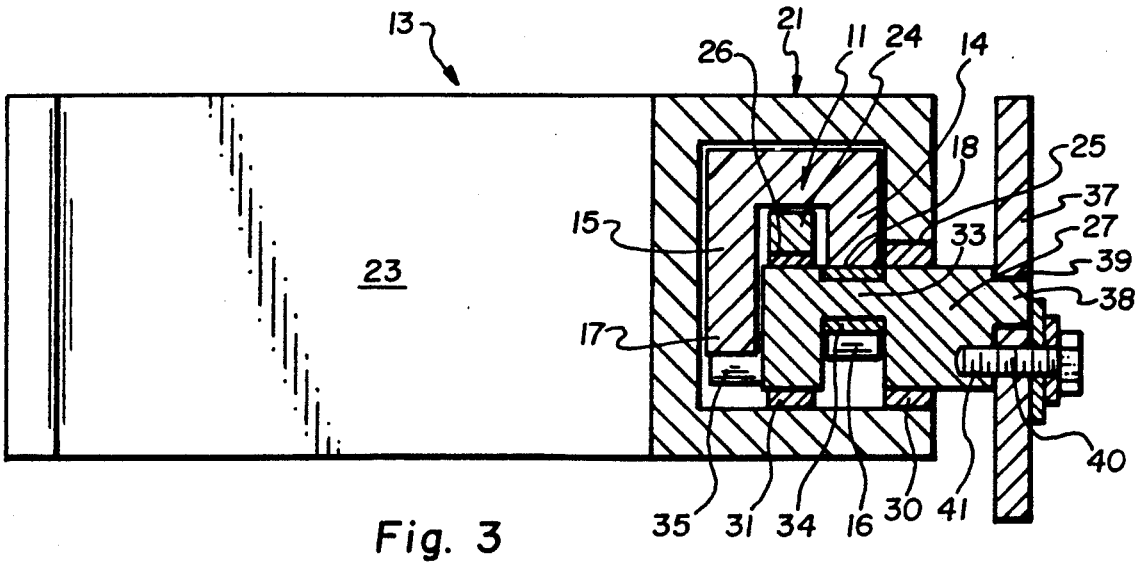
FIG. 3 is a cross-sectional view taken along lines III—III of FIG. 2.
Figure 4:
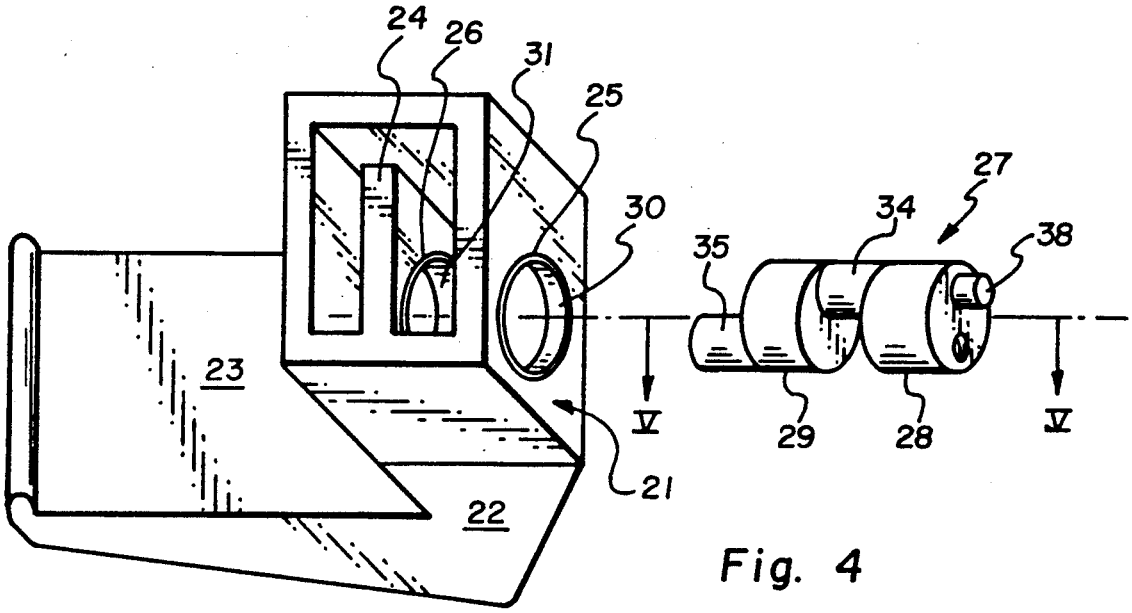
FIG. 4 is an exploded perspective view of the rider and crank shaft of the invention.

As best seen in FIGS. 3 and 4, the housing 21 has included therein a generally rectangular shaped guide member 24 which is formed so as to attach to the inner surface of the hollow rectangular housing 21 so as to extend into channel 20 of the rail 11 when the rail 11 is inserted through the housing 21.

Housing 21 further includes an opening 25 therethrough, and guide member 24 includes an opening 26 therethrough. Openings 25 and 26 are generally f equivalent diameter and have the identical longitudinal axis.

Figure 5:
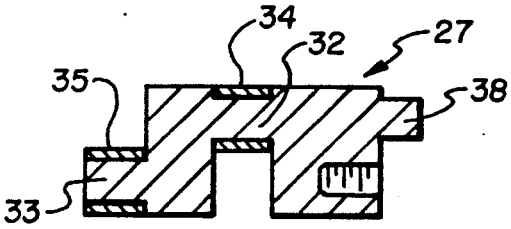
FIG. 5 is a cross-sectional view of the crank shaft of FIG. 4 taken along lines V—V.

The crank shaft 27 includes a pair of cylindrical supporting surfaces 28 and 29 which are mounted in openings 25 and 26 respectively. Supporting surfaces 28 and 29 may be fitted into openings 25 and 26 directly or, if desired, may include angularly shaped bearings or bushings 30 and 31 in order to decrease the rotational friction therebetween. As best seen in FIGS. 4 and 5, supporting surface 28 is connected to supporting surface 29 by a pinion 32. Supporting surface 29 also has extending thereon a pinion 33 which is located on the side thereof opposite pinion 32. Pinions 32 and 33 are offset from the central axis of the crankshaft a distance equivalent to the linear distance between notches 18 and 19 of racks 14 and 15 respectively. Further, pinions 32 and 33 are radially offset from each other a distance of 180 degrees around the longitudinal axis of the crank shaft. Each pinion 32 and 33 may be surrounded by a bushing 34 and 35 respectively if desired in order to decrease the wear thereon during use.

In the preferred embodiment of the represent invention, the crankshaft 27 has a diameter of 1 inch at surfaces 28 and 29, and a diameter of ½ inch at pinions 32 and 33 (or bushings 34 and 35 if present). The distance between adjacent notches 18 of rack 14 is equivalent to the distance between adjacent notches 19 of rack 15 and is 1 inch. The offset of racks 14 and 15 cause the center of notches 18 of rack 14 to be linearly offset a distance of ½ inch from the center of notches 19 of rack 15.

Thus, as shown in FIG. 3, pinion 32 can rest in a notch 18 while at the same time pinion 33 rests in a notch 19 (which is offset ½ inch below notch 18). When the crankshaft 27 rotates, to move rider 13 upwardly, pinion 33 rotates out of the notch 19 which is below the notch 18 in which pinion 32 rests, and rotates into a new notch 19 which is above the notch 18 in which the pinion 32 rests. Further rotation, as is readily apparent, causes pinion 32 to rotate out of notch 18 and into a new notch 18 thereabove. In this manner, the rider 13 progresses up the railing.

Pinions 32 and 33 (or bushings 34 and 35 if present) are of a diameter only slightly smaller than the diameter of the semi-cylindrically shaped notches 18 and 19 of racks 14 and 15. When crank shaft 27 is rotated about its longitudinal axis by rotation of handle 36, the pinions 32 and 33 progressively engage and disengage notches 18 and 19 due to the offset of pinions 32 and 33 from the longitudinal axis of the crank shaft 27, and progress upwardly or downwardly along the racks 14 and 15, rotation of the crankshaft 27 causing the pinions 32 and 33 to continuously engage and disengage through adjacent notches 18 and 19 as the rider 13 travels upwardly or downwardly along the rail 11.

As can be seen, the central longitudinal axis of the crankshaft 27 passes within the semi-cylindrical area of the notches 18 and 19, i.e. the teeth 16 and 17 extend beyond the central longitudinal axis of the crankshaft 27 when they are in their assembled configuration. Therefore, due to this relative orientation, and the offset of pinions 32 and 33, at least one of the pinions 32 or 33 is always located within a notch 18 or 19, regardless of the rotational position of the crank shaft 27.

Further, in at least two rotational positions (each position being 180 degrees apart) both pinions 22 and 23 are simultaneously located within their respective notch 18 or 19. In either of these two positions the rider 13 is effectively locked in place relative to rail 11. In other words, a load on platform 23 tending to force rider 13 in a downward direction, can not generate a rotational force in crank shaft 27 to cause the pinions 22 or 23 to rotate out of position relative to notches 18 or 19 when the crankshaft is in either of these locked positions. Therefore, the design of the present invention requires no locking mechanism that must be intentionally moved into a locking position. Instead, two rotational positions of the crankshaft 27 effectively prevent rider 13 from moving along rail 11 due to a load on the platform 23 without the need for an alternative locking mechanism. However, rotation of handle 36 causes rotation of the crank shaft 27 in a smooth, continuous manner throughout the entire rotational cycle thereof. Elevation or lowering of the platform 23 continues in a continuous manner even though end rotation of the crankshaft 27 passes the pinions 32 and 33 through two locking positions.

Handle 36 is attached to shaft 27 by means of a bar 37 in a conventional manner. Bar 37 is locked in position relative to crank shaft 27 such that rotation of the bar 37 causes rotation of crank shaft 27 without any relative slipping. As best seen in FIG. 3, extension 38 of crank shaft 27 can extend into an opening 39 in the bar 37 and a bolt 40 may be inserted through bar 37, into bolt hole 41. Although the manner of connecting bar 37 and handle 36 to the crank shaft 27 is disclosed, it is anticipated that any conventional method of connecting a handle to crank shaft 27 may be used in conjunction with the present invention.

Likewise, handle 36 may be attached to bar 37 in any similar, well known manner which will allow for ease and comfort of the user while operating the jack 10.

In use, the platform 23 is placed under an object to be lifted such as a bumper of a vehicle, and handle 36 is rotated to cause rider to move up rail 11. When the object is lifted to the desired height, handle 36 is positioned such that bar 37 is parallel with the longitudinal of rail 11, thus positioning both pinions 32 and 33 within a respective notch 18 and 19 to lock the rider 13 in position and prevent the force of the object from causing the rider 13 to move back down rail 11. When it is desired to lower the object, the handle 36 is simply rotated in the opposite direction.

Figure 6:
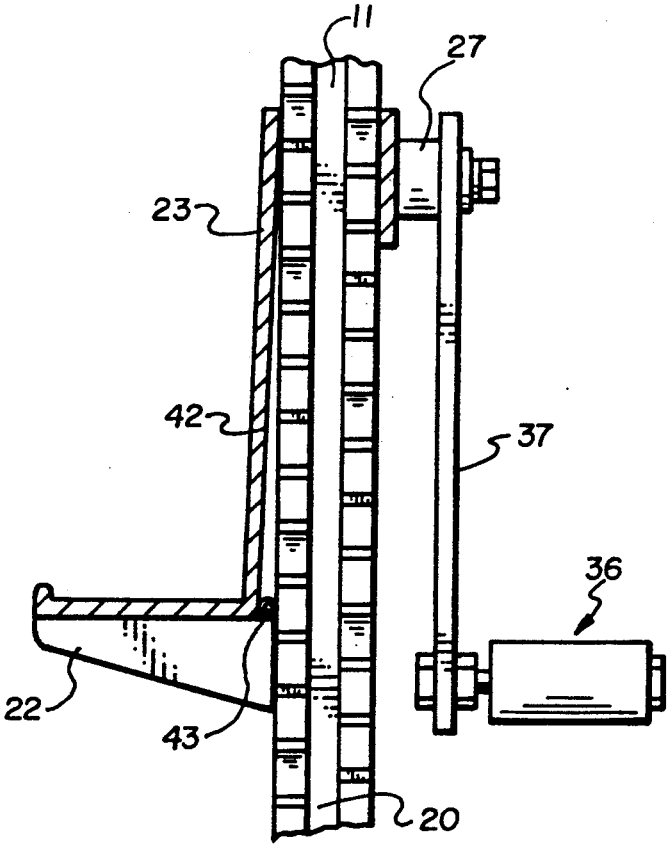
FIG. 6 is a cross-sectional view of the jack taken along lines VI—VI of FIG. 2.

As shown in FIG. 6, the L-shaped support surface and lifting platform 23 may be formed of a single continuous piece of flat elongate rectangularly shaped material. Since during the course of operation of the jack 10, the supporting surface 42 of element 23 contacts and slides along the rail 11, it may be desired to insert a bearing 43 therebetween such as a pin and bushing type bearing which may be pinned in place between the pair of L-shaped lifting members 22 in a well known manner.

It is to be understood that variations and modifications of the present invention may be made without departing from the scope hereof, and that the present invention is not to be limited by the specific embodiment disclosed herein, but only in accordance with the appended claims when read in light of the foregoing specification.

I claim:

1. A self locking jack comprising a support base, a rail adapted to be vertically mounted in said support base, said rail having a pair of rows of notches projecting from one face thereof with the notches in one row being offset with respect to the notches of the other row, a rider adapted to reciprocate along said rail, said rider including a housing, a load platform projecting from said housing, a crankshaft extending through a wall of said housing, and a pair of pinions carried by said crankshaft and offset with respect to a longitudinal axis of said crankshaft, one of said pinions being aligned with and rotatable into and out of notches of one of said pairs of rows and another of said pairs of pinions being aligned with and rotatable into and out of the notches of another of said pair of rows, and a handle connected to said crankshaft, whereby, turning of the handle will rotate the crankshaft to sequentially move the pinions into and out of the notches to thereby move the rider along the rail.

2. A self locking jack as in claim 1, wherein said crankshaft further includes a supporting surface located between said pair of pinions, and said housing includes a guide for rotatably securing said supporting surface to said housing.

3. A jack comprising a support base, a rail adapted to be vertically mounted in said support base, said rail having a pair of racks located along a longitudinal axis thereof, each of said racks including a plurality of uniformly spaced notches located thereon, said notches of one of said racks being longitudinally offset from the notches of the other of said racks, a rider adapted to reciprocate along said rail, said rider including a housing, a load platform projecting from said housing and a crankshaft including a pair of pinions, said pinions being offset with respect to a longitudinal axis of said crankshaft a distance equivalent to the offset of said notches of said racks, one of said pinions being aligned with and rotatable into and out of the notches of one of said pair of racks and the other of said pinions being aligned and rotatable into and out of the notches of the other of said racks, and a handle connected to said crankshaft, whereby, turning of the handle will rotate the crankshaft to sequentially move the pinions into and out of the notches to thereby move the rider along the rail.

4. A jack according to claim 3 wherein said crankshaft is positioned relative to said racks such that every rotational position of said crankshaft corresponds to at least one of said pinions being located in a notch of at least one of said racks.

5. A jack according to claim 4 wherein at least two rotational positions of said crankshaft corresponds to both of said pinions being at least partially positioned in a notch of each of said racks, whereby, when said crankshaft is oriented in either of said two positions, the force of a load on the loading platform cannot cause rotation of the crankshaft.

* * * * *